US012782086B2

(12) United States Patent
Taher

(10) Patent No.: US 12,782,086 B2
(45) Date of Patent: Nov. 3, 2026

(54) UNIVERSAL HOLSTER FOR SIGHTED HANDGUNS

(71) Applicant: DELTA FIREARMS, LLC, Houston, TX (US)

(72) Inventor: Shawn Taher, Houston, TX (US)

(73) Assignee: Delta Firearms, LLC, Houston, TX (US)

( * ) Notice: Subject to any disclaimer, the term of this patent is extended or adjusted under 35 U.S.C. 154(b) by 129 days.

(21) Appl. No.: 18/781,226

(22) Filed: Jul. 23, 2024

(65) Prior Publication Data

US 2024/0377160 A1 Nov. 14, 2024

Related U.S. Application Data

(63) Continuation of application No. 16/742,511, filed on Jan. 14, 2020, now abandoned.

(51) Int. Cl.
*F41C 33/02* (2006.01)
*F41C 33/04* (2006.01)

(52) U.S. Cl.
CPC ..... *F41C 33/0272* (2013.01); *F41C 33/0245* (2013.01); *F41C 33/0254* (2013.01); *F41C 33/043* (2013.01); *F41C 33/048* (2013.01)

(58) Field of Classification Search
CPC ..... F41C 33/0272; F41C 33/0245; F41C 33/0254; F41C 33/043; F41C 33/048
See application file for complete search history.

(56) References Cited

U.S. PATENT DOCUMENTS

| | | | | |
|---|---|---|---|---|
| 9,134,093 | B2 | 9/2015 | Yeates | |
| 9,222,750 | B1 * | 12/2015 | Keepers | F41C 33/0209 |
| 9,500,440 | B2 | 11/2016 | Gordon et al. | |
| 9,829,276 | B2 * | 11/2017 | Laemmlen | F41C 33/048 |
| 10,018,447 | B1 | 7/2018 | Alford | |
| 2005/0178808 | A1 * | 8/2005 | Buis | F41C 33/043 224/198 |
| 2005/0279788 | A1 * | 12/2005 | Lowe | F41C 33/0254 224/244 |
| 2006/0026886 | A1 | 2/2006 | Doukas | |
| 2014/0027486 | A1 * | 1/2014 | McGee | F41C 33/045 224/587 |
| 2016/0216065 | A1 * | 7/2016 | Tedder | F41C 33/0245 |
| 2018/0321014 | A1 | 11/2018 | Rassias | |
| 2020/0256638 | A1 * | 8/2020 | Bynoe | F41C 33/043 |

OTHER PUBLICATIONS

Crossbreed Holster for GLOCK 26 27 33 with Laser | Crimson Trace Lasergrips (1 page) [cited in parent case U.S. Appl. No. 16/742,511].
Light & Laser Bearing Holsters (12 pages) [cited in parent case U.S. Appl. No. 16/742,511].

* cited by examiner

*Primary Examiner* — Derek J Battisti
(74) *Attorney, Agent, or Firm* — HUNTON ANDREWS KURTH LLP

(57) ABSTRACT

A holster for concealing a laser-sighted handgun is provided. Advantageously, the holster fits lasers and handguns of many sizes. The holster may be readily attached to a belt around the waist or ankle. The holster is configured such that it is comfortable and such that a handgun is concealable with most usual movements of a user. For example, a handgun remains in substantially the same position within the holster when a user bends forward thereby remaining concealed.

20 Claims, 4 Drawing Sheets

UNIVERSAL HOLSTER FOR SIGHTED HANDGUNS

CROSS-REFERENCE TO RELATED APPLICATIONS

This application is a continuation of U.S. Ser. No. 16/742,511 filed Jan. 14, 2020 which application is incorporated herein by reference.

FIELD OF THE INVENTION

The present invention relates generally to a universal holster for handguns having a sight such as, for example, a laser sight.

BACKGROUND AND SUMMARY

Current available handgun holsters are not adequately adapted for sighted weapons such as those handguns with a laser sight permanently or removably affixed below or above the gun barrel. That is, in order for a traditional holster to adequately accommodate a laser sighted handgun the holster would have to be custom made for the specific handgun whether it be a 9 mm, a 38, a 45, etc. and perhaps even customized for the specific laser sight involved. What is needed is a universal holster that will accommodate a variety of size handguns and a variety of various laser sights available. It would be advantageous if such a holster were comfortable to wear and concealed the handgun even when the user was bending and/or moving. It would further be advantageous if such a holster could be made to be worn on the waist or ankle with a conventional belt or strap. It would further be advantageous if such a holster facilitated rapid removal of such a laser-sighted handgun from the holster.

Advantageously, the present invention solves the above-mentioned issues with conventional holsters and has additional advantages. In one embodiment the invention pertains to a holster for concealing a laser-sighted handgun comprising a closed front tab; a closed rear tab; and a pouch for storing a firearm between said closed front tab and closed rear tab. The pouch comprises a top opening for receiving a handgun barrel, a bottom opening adjacent the rear tab, and a bottom opening adjacent the front tab. The front tab comprises a front tab fastener configured to be attached to a user. The rear tab comprises a rear tab fastener configured to be attached to a user. The front tab fastener is nearer the top of the holster than the rear tab fastener. In this manner a handgun remains in substantially the same position within the holster when a user moves such as when a user bends forward.

BRIEF DESCRIPTION OF THE DRAWINGS

So that the manner in which the above recited features, advantages, and objects of the present invention are attained and can be understood in detail, a more particular description of the invention, briefly summarized above, may be had by reference to the embodiments thereof which are illustrated in the appended drawings. It is to be noted, however, that the appended drawings only illustrate preferred embodiments of this invention, and are therefore not to be considered limiting of its scope, for the invention may admit to other equally effective embodiments that vary only in detail. In the drawings.

Figure 1:
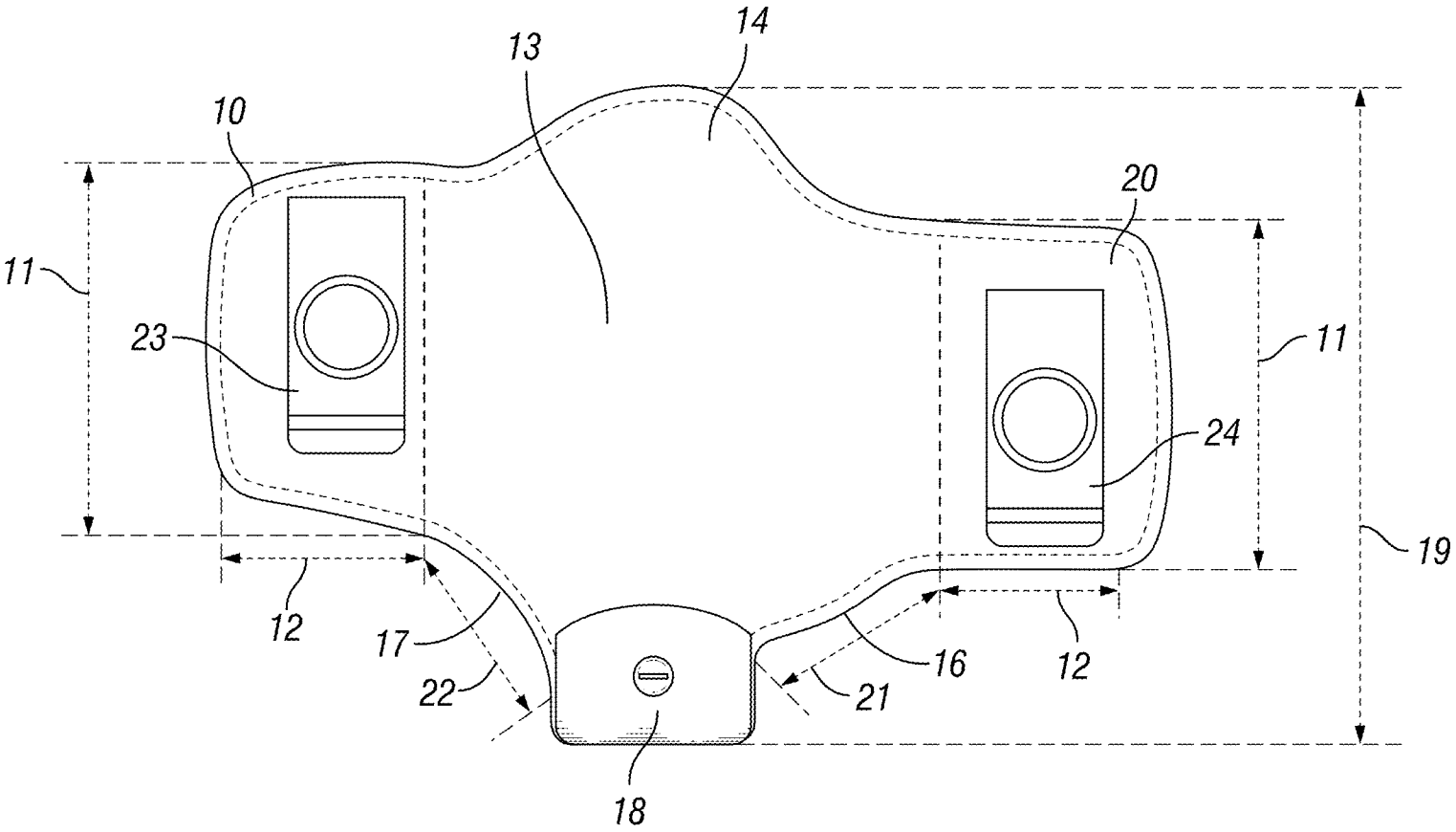
FIG. 1 shows a side of a specific holster embodiment.

Certain terms are used throughout the following description and claims to refer to particular system components. This document does not intend to distinguish between components that differ in name but not function.

GENERAL HOLSTER DESCRIPTION AND MANUFACTURING METHOD

The holsters of the present invention may be configured in any convenient manner and such manners may vary depending on the desired characteristics, available supplies, manufacturing equipment, and the like. Typically, the holsters comprise a front tab, a rear tab, and a pouch for storing a firearm such as a sighted handgun between said closed front tab and closed rear tab.

The front tab is on the portion of the holster designed to be facing and/or is near the forward portion of the user when, for example, the holster is attached around a user's waist or ankle. That is, the front tab would be closer to the stomach than the back of the user. Conversely, the rear tab of the holster is designed to be facing to the rear of the user when, for example, the holster is attached around a user's waist or ankle. That is, the rear tab would be closer to the back than the stomach of the user.

The front tab and rear tab are each typically closed meaning that they generally do not need to have any openings. The material of the front tab, rear tab, and or other parts of the holster may be the same or different and is not particularly critical. Generally, the material may be any material that provides the desired characteristics. Suitable materials typically include, for example, pliable plastics and leathers such as polymers, synthetic leathers, and natural leathers.

The front tab may be an integral portion of material or alternatively may comprise a body facing material component and a material component that faces away from the body wherein the two components are stitched and/or somehow adhered to each other, or both during the manufacturing of the tab and/or holster. The same is true of the rear tab.

The size of the front tab and rear tab of the holster may vary depending upon the desired characteristics of the holster and the materials employed. In this vein the height, length and width of the front tab and rear tab of the holster may be the same or different and are typically sufficient to support the weight of the sighted handgun using the materials employed. Typically, the front tab and/or the back tab has a length of at least about 1.5, or at least about 1.75, or at least about 2 inches up to about 3.5, or to up to about 3.25, or up to about 3 inches. Typically, the front tab and/or the back tab has a height of at least about 3, or at least about 3.25, or at least about 3.5 inches up to about 4.25, or to up to about 4.5, or up to about 5 inches. The width of the front tab and/or the back tab may vary from about 0.0625 inches to about 0.25 inches.

The front tab usually comprises a front tab fastener configured to be attached to a user while the rear tab comprises a rear tab fastener configured to be attached to a user. In some embodiments the front tab fastener and rear tab fastener may span from the front tab to the rear tab such that the front tab and rear tab fastener are integral and/or attached to each other. In some embodiments the front tab and rear tab fastener may be a clip or other mechanism that is configured to attach the tab to a waist or ankle belt of the user.

In some embodiments the front tab fastener is nearer the top of the holster than the rear tab fastener. That is, the front tab fastener acts to hold the front of the holster in a higher position that the rear tab fastener holds the rear of the holster. Thus, the holster may be affixed to the user in an angled position. In this manner, a handgun in the holster may remain in substantially the same position within the holster when a user bends forward or otherwise engages in natural body movement. Also, the angled position of the holster may also allow the holster to be configured such that a handgun remains substantially concealed when a user bends forward or otherwise engages in natural body movement.

The holster also comprises a pouch for storing a firearm between said closed front tab and closed rear tab. The pouch may be made of the same or different material as described above for the front tab and rear tab. The size and shape of the pouch may vary depending upon the desired characteristics. Typically, the pouch comprises a top opening for receiving a handgun barrel, a bottom opening adjacent the rear tab, and a bottom opening adjacent the front tab. In this manner the holster is shaped to receive the barrel and laser-sight extending through the bottom opening adjacent the rear tab.

The size and shape of each of the aforementioned openings in the pouch may vary depending upon the materials and desired characteristics. Typically, the bottom opening adjacent the rear tab is slightly larger than the bottom opening adjacent the front tab. In this manner the bottom opening adjacent the rear tab may be configured to receive a laser sight mounted to a barrel of a handgun. That is, in contrast to many prior holsters with a bottom opening to allow debris to fall through, the instant holster's bottom openings may be configured such that a laser sight may be employed on the weapon to be holstered and be concealed without slipping through the holster even with movement of the user to a bending, kneeling, or other position. In some embodiments, the bottom opening adjacent the rear tab may range in length from about 1.5, or from about 2 up to about 4 inches or up to about 3 inches when the holster is laid flat without a weapon. The bottom opening adjacent the front tab is usually slightly smaller and may range in length from about 1.0, or from about 1.25 up to about 3 inches or up to about 2 inches when the holster is laid flat without a weapon.

The top opening of the pouch may also vary in size depending upon the desired characteristics. Typically, the top opening of the pouch has a length of from 3.5 to about 5 inches when the pouch is laid flat without a weapon. On the other hand, the top opening of the pouch generally has a length of from 2 to about 4 inches when the pouch is occupied by a laser-sighted handgun.

In some embodiments, the pouch extends upwardly above the closed front tab and/or extends upwardly above the closed rear tab. In this manner, the height may be selected to be from about 6 to about 8 inches. If desired, the top of the pouch may be rounded in an oval shape.

Typically, the closed front tab, the closed back tab, and the pouch are comprised of a pliable material such as natural or synthetic leather and configured such that they all curve in the same direction. In this manner the holster may be made to conform to a user's body. The interior of the pouch may also be natural or synthetic leather or alternatively the interior may be lined with a different material. In some embodiments the interior of the pouch may comprise a material such as polished leather or another material that facilitates rapid removal of a sighted handgun.

SPECIFIC EMBODIMENTS

FIG. 1 shows an exemplary embodiment of a holster made from sewing or stitching or attaching two opposing pieces of leather or other material to form a front closed tab 10 and rear closed tab 20 leaving an open pouch 13 therebetween. The height 1 of each closed tab is about 3.75 inches while the length 12 of each closed tab is about 2.25 inches. The closed tabs have a pouch 13 between them. The pouch has a top opening 14 for receiving a handgun. The top opening of the pouch has a length 15 of about 4 inches from front tab to rear tab when the pouch is empty and laid flat.

As shown the holster has a bottom opening 16 adjacent the rear tab and a bottom opening 17 adjacent the front tab with the pouch being closed at bottom 18. The pouch 14 has a height 19 of about 7 inches. The bottom opening 16 adjacent the rear tab is slightly larger than the bottom opening 17 adjacent the front tab. In this embodiment, the bottom opening 16 adjacent the rear tab is a length 21 of about 2.5 inches when the holster is laid flat without a weapon. The bottom opening 17 adjacent the front tab has a length 22 of about 2 inches when the holster is laid flat without a weapon.

A front tab clip 23 is attached to the front tab and rear tab clip 24 is attached to the rear tab. Each are configured to clip to a user belt. The front tab clip is typically nearer the top of the front tab than the rear tab clip is to the top of the rear tab. It is desired that the front portion of the holster be higher than the rear when affixed to a user to facilitate concealment and facilitate the weapon staying secured in the holster. That is, unlike many prior art holsters the instant configuration provides concealability of the weapon without requiring connectors and/or any associated two or more adjustment holes on a clip and/or on a band for the connectors. There is no adjustment necessary to maintain concealability and securement of the weapon in the holster.

Figure 2:
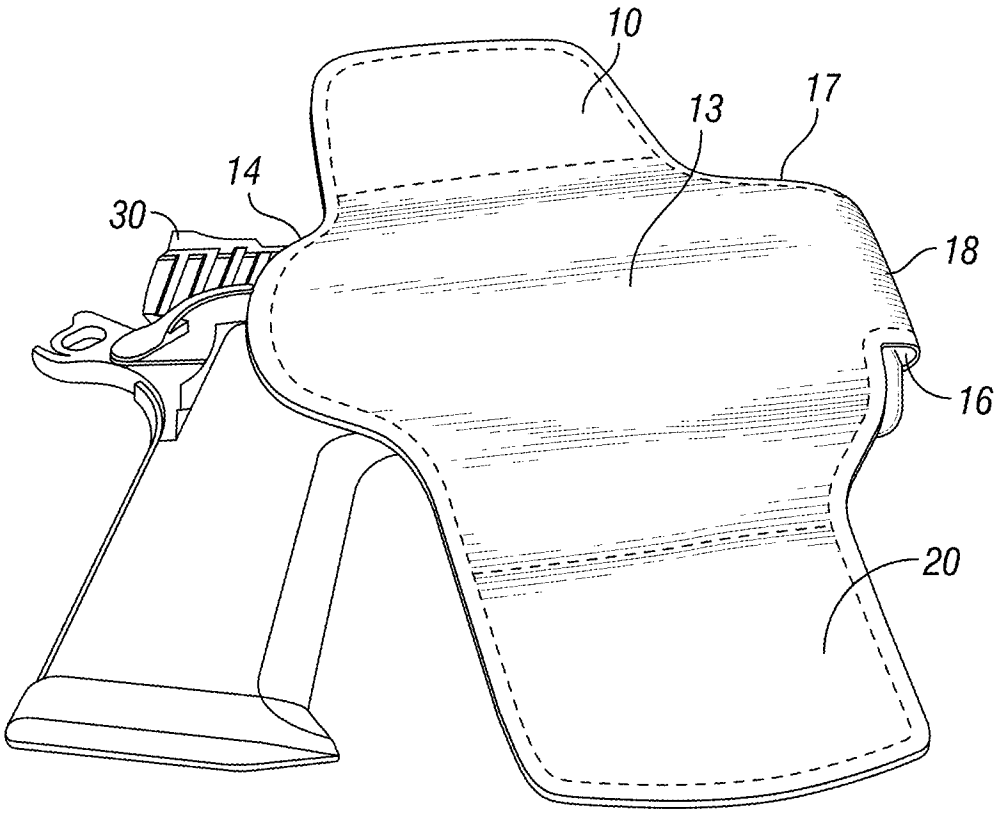
FIG. 2 shows the opposing side of a specific holster embodiment with the handgun in the holster.
Figure 3A:
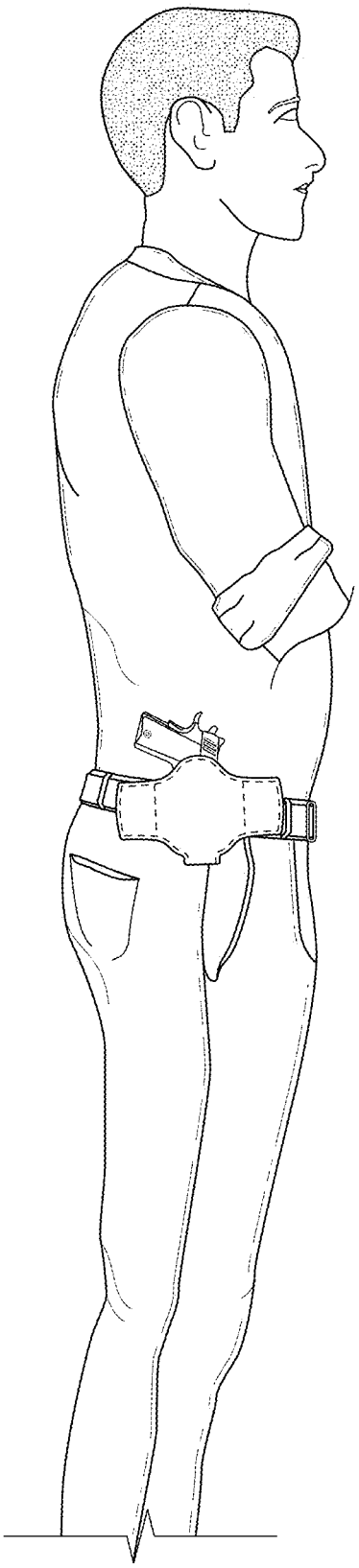
FIG. 3A shows a holster affixed to the user in an angled position.
Figure 3B:
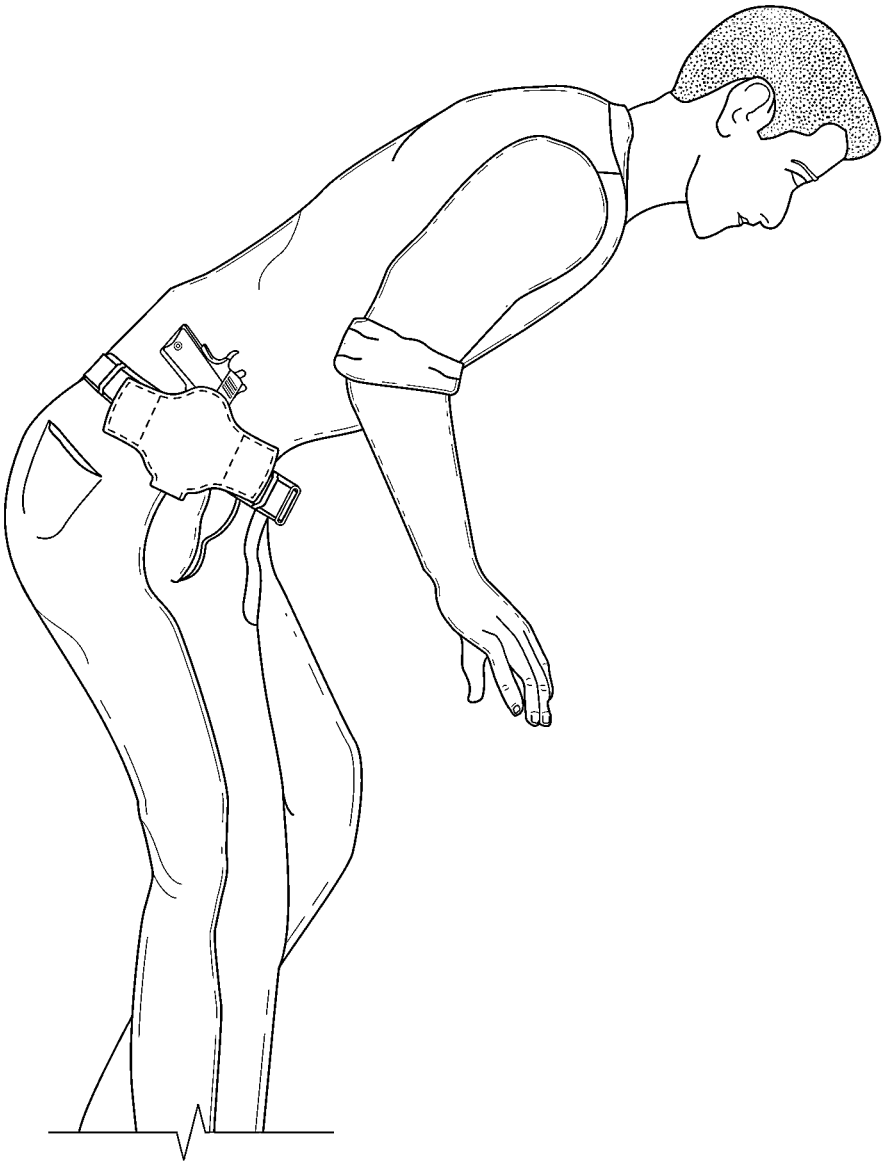
FIG. 3B shows that the holster remains in substantially the same position within the holster when a user bends forward or otherwise engages in natural body movement.

FIG. 2 shows a sighted handgun 30 in the holster depicted in FIG. 1.

The holster depicted in FIGS. 1 and 2 may be made in any convenient manner. For example, two pieces of leather may be cut in the desired shape of the holster as mirror images except that one of the two pieces will have an extension that will become closure 18 at the bottom of the pouch. The mirror images may then be stitched along the perimeter of what will become the front and rear tab and glued or otherwise adhered in the front and rear tab portions to form the closed front and rear tabs. The extension may then be folded and riveted or otherwise affixed to the opposing piece of leather forming closure 18 and openings 16 and 17.

What is claimed is:

1. A holster for concealing a laser-sighted handgun comprising: a closed front tab; a closed rear tab; and a pouch for storing a firearm between said closed front tab and closed rear tab, wherein the pouch comprises a top opening for receiving a handgun barrel, a first bottom opening adjacent the closed rear tab, and a second bottom opening adjacent the closed front tab; wherein the front tab comprises a front tab fastener configured to be attached to a user; wherein the rear tab comprises a rear tab fastener configured to be attached to a user; wherein the front tab fastener is nearer the top of the holster than the rear tab fastener; wherein the holster is made from two pieces of material, one of the two pieces has an extension, and the extension is folded to the opposing piece forming the bottom, the first bottom opening adjacent the closed rear tab, and the second bottom opening adjacent the closed front tab; wherein the front tab fastener and rear tab fastener are configured to hold the front of the holster in a higher position than the rear tab fastener holds the rear of the holster such that the holster may be affixed to a user in an angled position and a handgun in the holster may remain in substantially the same position within the holster when a user bends; and wherein concealability is provided in the absence of adjustment holes on the front tab fastener and in the absence of adjustment holes on the rear tab fastener.

2. The holster of claim 1 wherein the bottom opening adjacent the rear tab is larger than the bottom opening adjacent the front tab.

3. The holster of claim 1 wherein the bottom opening adjacent the rear tab is configured to receive a laser sight mounted to a barrel of a handgun.

4. The holster of claim 1 wherein the front tab fastener is a clip configured to be attached to a belt of the user.

5. The holster of claim 1 wherein the rear tab fastener is a clip configured to be attached to a belt of the user.

6. The holster of claim 1 wherein the pouch extends upwardly above the closed front tab.

7. The holster of claim 1 wherein the pouch extends upwardly above the closed rear tab.

8. The holster of claim 1 wherein the pouch extends upwardly above the closed rear tab and closed front tab, and wherein the holster is configured such that a handgun remains in substantially the same position and substantially concealed when a user bends forward.

9. The holster of claim 1 wherein the closed front tab, the closed rear tab, and the pouch are configured such that the holster conforms to a user's body.

10. The holster of claim 1 wherein the closed front tab; the closed rear tab; and the pouch are configured such that they curve in the same direction.

11. The holster of claim 1 wherein the closed front tab and the closed rear tab are comprised of leather.

12. The holster of claim 1 wherein the pouch is comprised of leather.

13. The holster of claim 1 wherein the closed front tab, the closed rear tab, and the pouch are each comprised of a leather and wherein the leather is selected from natural leather and synthetic leather.

14. The holster of claim 1 wherein the closed front tab has a length of from 1.5 to 3 inches and a height of from 3 to 5 inches.

15. The holster of claim 1 wherein the closed rear tab has a length of from 1.5 to 3 inches and a height of from 3 to 5 inches.

16. The holster of claim 1 wherein the pouch has a height of from 6 to 8 inches.

17. The holster of claim 1 wherein the top opening of the pouch has a length of from 3.5 to 5 inches when the pouch is empty.

18. The holster of claim 1 wherein the top opening of the pouch has a length of from 2 to 4 inches when the pouch is occupied by a laser-sighted handgun.

19. The holster of claim 1 wherein an interior of the pouch comprises a surface to facilitate rapid removal of a laser-sighted handgun.

20. The holster of claim 1 wherein an interior of the pouch comprises polished leather.

* * * * *